United States Patent [19]

Steenhoek

[11] 4,087,997

[45] May 9, 1978

[54] PIPE END SHAPER TOOL

[76] Inventor: Dwayne K. Steenhoek, 507 Main St., Pella, Iowa 50219

[21] Appl. No.: 787,385

[22] Filed: Apr. 14, 1977

[51] Int. Cl.[2] ..... B21D 41/02

[52] U.S. Cl. ..... 72/122; 72/126

[58] Field of Search ..... 72/74, 122, 123, 126

[56] References Cited

U.S. PATENT DOCUMENTS

| | | | |
|---|---|---|---|
| 2,813,442 | 11/1957 | Wingate | 72/126 |
| 2,905,226 | 9/1959 | Knorr | 72/126 |
| 2,956,459 | 10/1960 | Brookhouse | 72/126 |

*Primary Examiner*—Lowell A. Larson

*Attorney, Agent, or Firm*—Henderson, Strom, Sturm, Cepican & Fix

[57] ABSTRACT

A shaper tool for truing the end portion of a pipe or tubing, including a plurality of cylindrical projections adapted to be inserted into the end of a deformed tube, and means to adjust the relative position of the projections to exert outward radial force on the inside of the tube.

1 Claim, 6 Drawing Figures

PIPE END SHAPER TOOL

BACKGROUND OF THE INVENTION

The present invention relates generally to hand tools and more particularly to a hand tool useful for shaping the end of a deformed pipe into a circular configuration.

Many expander and shaping tools have been devised to true thin walled tubing. Most devices, however, incorporate a chucktype device which include a complicated structure of springs and wedges. These chucktype devices also exert uneven pressure on the pipe or tubing and frequently cause splitting. Those concerned with the problem recognize a need for a simpler tool which eliminates splitting.

SUMMARY OF THE INVENTION

The tool of the instant invention includes a plurality of cylindrical projections movably mounted with respect to each other and useful for exerting an evenly applied force to the inside of a pipe, such as a muffler neck or an exhaust pipe. A pair of projections is mounted on a first member and a third projection is mounted on a second member. Means for aligned longitudinal movement of the first member with respect to the second member is provided such that an outward radial force is progressively increased as the tool is simultaneously rotated about the axis of a deformed pipe and the pipe approaches a circular configuration.

An object of the present invention is the provision of an improved pipe end shaper tool.

Another object is to provide a pipe end shaper tool of a simplified construction that is economical to manufacture and maintain.

A further object of the invention is the provision of a pipe end shaper tool that is self-contained, does not require the use of auxiliary tools, and is not restricted to a specific work area.

Still another object is to provide a pipe end shaper tool that can be easily adjusted for use with pipes of various diameter and that can be inserted in a severely deformed pipe.

A still further object is to provide a pipe end shaper tool that applies pressure evenly about the entire circumference of the inside of a pipe.

Other objects, advantages and novel features of the present invention will become apparent from the following detailed description of the invention when considered in conjunction with the accompanying drawings.

DESCRIPTION OF THE PREFERRED EMBODIMENT

Figure 1:
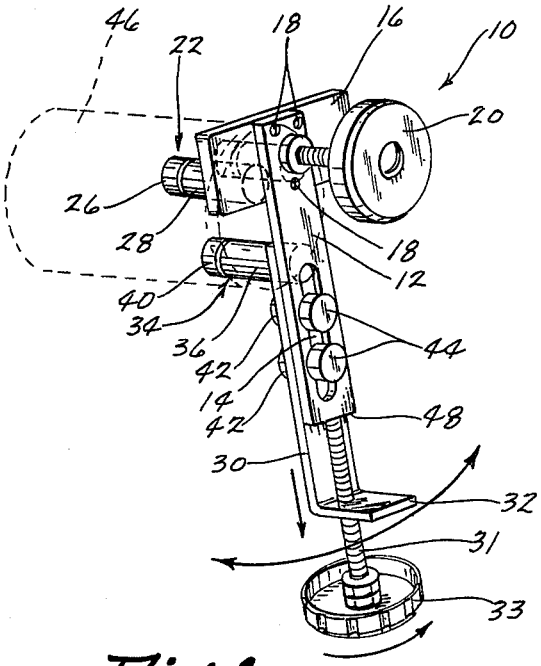
FIG. 1 is a perspective view of the tool of this invention inserted in the end of a pipe (shown in phantom)
Figure 2:
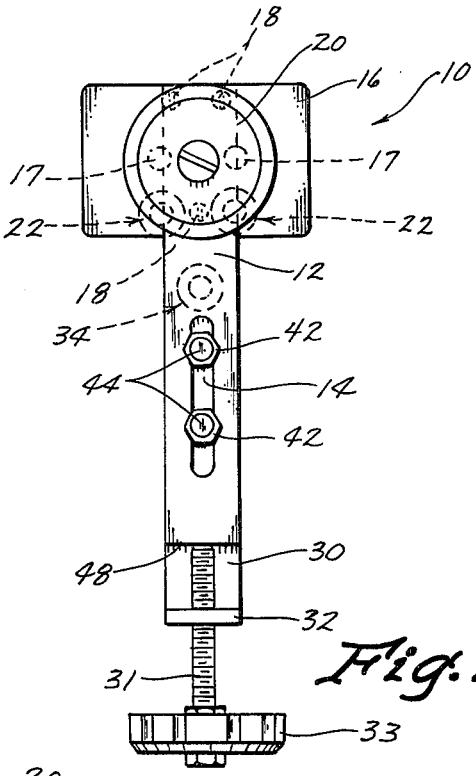
FIG. 2 is a top plan view of the tool.

Referring now to the drawings, wherein like reference numerals designate identical or corresponding parts throughout the several views, FIG. 1 shows the invention generally designated by the numeral 10. The tool 10 includes a first elongated member 12 having a longitudinal slot 14 formed near one end thereof. A plate 16 is rigidly attached to the opposite end thereof by any suitable means such as fasteners 18. The plate 16 extends outwardly from and normal to the first member 12 and a hand hold 20 is rigidly attached to the first member 12 and projects upwardly therefrom. It is understood that the first member 12, the plate 16, and the hand hold 20 could be integrally formed.

Figure 3:
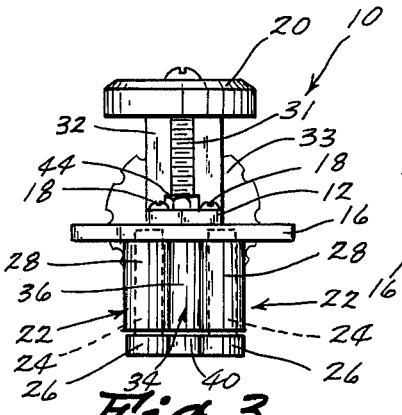
FIG. 3 is a front elevational view thereof.
Figure 4:
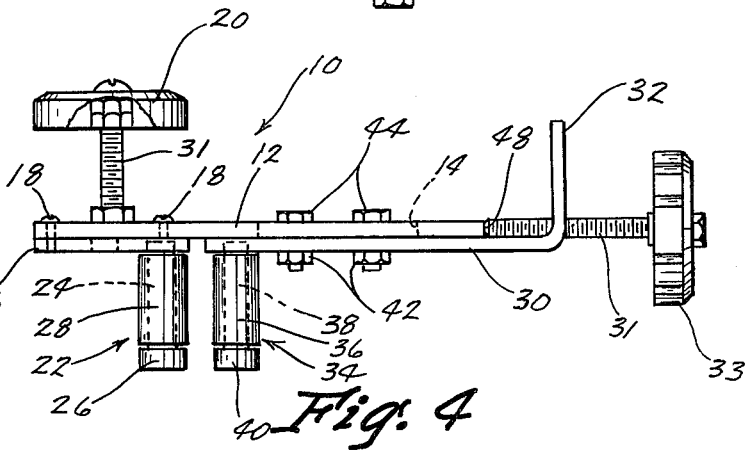
FIG. 4 is a side elevational view thereof.

A pair of cylindrical projections 22 are attached to the underside of plate 16 and extend normal thereto, as best shown in FIGS. 3 and 4. The projections 22 include a shaft 24 having an enlarged end 26. The shaft 24 is rigidly attached to the underside of plate 16, as by attachment to threaded holes 17, and a cylindrical sleeve 28 is rotatably fitted on shaft 24.

The tool 10 further includes a second elongated member 30 having a raised portion 32 at one end. The raised portion 32 has a threaded opening therethrough (not shown) adapted to receive a threaded shaft 31 having an operator wheel 33. A third cylindrical projection 34 is attached to the underside of member 30 at the opposite end thereof. The projection 34 includes a sleeve 36 fitted on a shaft 38 having an enlarged end 40 similar to projections 22.

Member 30 has holes (not shown) formed therethrough to accommodate fasteners 42. The fasteners 42 have an enlarged portion 44, the undersides of which slidably engage the upper surface of member 12 near slot 14. The fasteners 42, in cooperation with the slot 14, serve to align the first member 12 with respect to the second member 30, and the slot 14 allows longitudinal movement of the member 12 with respect to member 30. Other means of providing aligned longitudinal movement, such as telescoping tubular members, may also be used.

In operation, the tool 10 is positioned such that the pair of projections 22 and the projection 34 extend into the open end of pipe 46. The operator wheel 33 is rotated clockwise as indicated in FIG. 1, forcing the end of threaded shaft 31 against the transverse edge 48 of member 12. The force exerted against edge 48 causes the first member 12 to move longitudinally away from second member 30. This extension, in turn, causes the pair of projections 22 and the third projection 34 to exert an outward radial force on the inside sidewall 50 of pipe 46. The tool 10 is then rotated about the axis of pipe 46 to form the pipe 46 to a circular cross-section.

Figure 5:
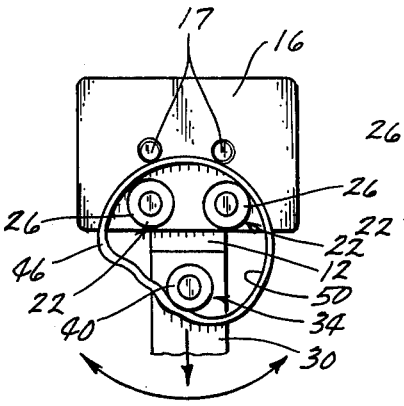
FIG. 5 is a partial bottom plan view of the tool showing the projections inserted in the end of a deformed pipe.
Figure 6:
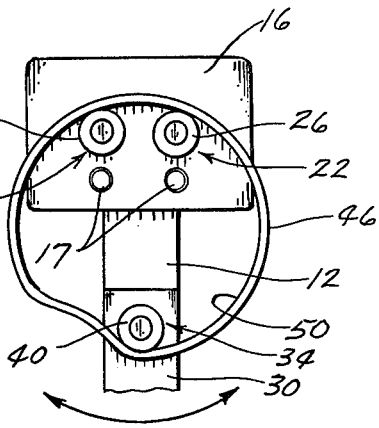
FIG. 6 is a view similar to FIG. 5, but showing the pair of projections of the first member attached in a different position to accommodate use in a larger pipe.

As shown most clearly by comparison of FIGS. 5 and 6, the first member 12 is progressively forced away from second member 30 as the pipe 46 approaches a circular configuration. The progressive extension of tool 10 is accomplished by rotation of operation wheel 33 simultaneously with rotation of the tool 10.

The tool 10 of this invention is self-contained and does not require the use of auxiliary tools. Thus, the use of the tool 10 is not restricted to a specific or limited work area. Further, the tool 10 is adjustable to various pipe diameters and can easily be inserted into a severely deformed pipe. Outward radial force is applied evenly over the entire inside circumference of the pipe 46 and the force can be progressively increased with each rotation of the tool 10. Since pressure is evenly applied, the tool 10 does not split the pipe 46 as the force against the pipe 46 is increased.

Obviously, many modifications and variations of the present invention are possible in light of the above teachings. It is therefore to be understood that, within the scope of the appended claims, the invention may be practiced otherwise than as specifically described.

I claim:

1. A pipe end shaper tool comprising:

a first elongated member having a closed longitudinal slot formed therein;

a hand hold rigidly attached to said first member and extending upwardly therefrom said hand hold including an enlarged circular top portion;

a plate rigidly attached to one end of said first member below said hand hold and extending outwardly normal to said first member, said plate having a plurality of pairs of threaded holes formed therein, said pairs of threaded holes being longitudinally spaced along said plate;

a pair of cylindrical projections threaded in one of said pairs of threaded holes and extending normal to said plate opposite the direction of said hand hold, each of said pairs of cylindrical projections including a threaded shaft, an enlarged circular end, and a cylindrical sleeve having the same outside diameter as said enlarged circular end, said sleeve being rotatably mounted on said threaded shaft between said plate and said enlarged circular end;

a second elongated member having a plurality of holes formed therein said holes being registerable with said slot of said first member, said second member being movably mounted for longitudinal movement with respect to said first member by a plurality of bolts extending through said holes in said second member and said slot in said first member, said bolts having enlarged heads slidably engaging the surface of said first member adjacent said slot, said second member including a raised portion extending upwardly from one end thereof, said raised portion having a threaded opening formed therethrough; and, a third cylindrical projection attached near the other end of said second member and extending normal thereto opposite the direction of said raised portion, said third cylindrical projection including a shaft attached to said second member, an enlarged circular end, and a cylindrical sleeve having the same outside diameter as said enlarged circular end, said sleeve being rotatably mounted on said shaft between said second member and said enlarged circular end; and adjusting means including a threaded adjusting shaft threadably received through the threaded opening in said raised portion of said second member and disposed in contacting relationship with the free end of said first member and an operator wheel attached to the forward end of said threaded adjusting shaft, whereby rotation of the operator wheel moves said first member, and the attached pair of projections with respect to said second member, and the attached third projection, thereby progressively increasing the distance there between.

* * * * *